US005778584A

United States Patent [19]

Pickle

[11] Patent Number: 5,778,584

[45] Date of Patent: Jul. 14, 1998

[54] SUN CATCHER KIT

[75] Inventor: Thomas L. Pickle, Toledo, Ohio

[73] Assignee: Craft House Corporation, Toledo, Ohio

[21] Appl. No.: 566,120

[22] Filed: Dec. 1, 1995

[51] Int. Cl.[6] ..... G09F 1/12

[52] U.S. Cl. ..... 40/800

[58] Field of Search ..... 40/800, 737

[56] References Cited

U.S. PATENT DOCUMENTS

| | | | |
|---|---|---|---|
| 636,319 | 11/1899 | Camp | 40/800 X |
| 1,802,170 | 4/1931 | Colbert et al. | 40/737 |
| 2,634,530 | 4/1953 | Herschede et al. | 40/737 X |
| 4,546,019 | 10/1985 | Schneider | 40/800 X |
| 5,251,391 | 10/1993 | Lan | 40/737 X |

*Primary Examiner*—Joanne Silbermann
*Attorney, Agent, or Firm*—Donald R. Fraser

[57] ABSTRACT

There is disclosed a sun catcher formed of a light transmitting panel one surface of which is provided with an outline of a pictorial display formed by slightly raised ridges and the opposite surface of which is provided with a detailed etching in registry with the pictorial display of the opposite surface. The ridges facilitate the deposition of a coloring medium such as a lightly transmitting paint to produce the desired coloring of the detailed etching upon the transmission of light through the coloring medium.

2 Claims, 1 Drawing Sheet

SUN CATCHER KIT

BACKGROUND OF THE INVENTION

1. Field of the Invention

The present invention relates to crafts and hobbies and more particularly to a kit for the making of a sun catcher.

2. Prior Art

Sun catchers are known in the prior art. Typically, the known sun catchers are formed of translucent panels with integral design s or pictures imprinted thereon. Also, panels of stained glass segments maintained in a predetermined pattern within a leaded framework have enjoyed popularity.

These objects of art are often mounted adjacent panes of glass windows. The incoming impinging light is transmitted through these assemblies to result in attractive and pleasing decorative objects.

SUMMARY OF THE INVENTION

A primary object of the invention is to produce a kit for making a sun catcher suitable for different designs.

Another object of the invention is to produce a sun catcher kit formed of a first translucent panel containing an etched design, such as a picture, therein; and a second cooperating translucent panel having a mirror image of the outline of the objects illustrated in the design on the facing surface for receiving a translucent coloring prior to assembling in juxtaposed relation.

Another object of the invention is to produce a kit for making a sun catcher capable of displaying an infinitesimal number of different designs in color schemes selected by the craftsman.

The above objects of the invention are typically achieved by a kit for making a sun catcher comprising a first light transmitting panel containing a display; a second cooperating light transmitting panel containing at least a mirror image of the outline of the display on the first panel on a facing surface of the second panel capable of receiving a light transmitting stain thereon; and a frame member for securing the first and second panels together in facing relation.

Further objects and advantages of this invention will be apparent from the following description and appended claims, reference being made to the accompanying drawings forming a part of the specification, wherein like reference characters designate corresponding parts in the several views.

DETAILED DESCRIPTION OF THE PREFERRED EMBODIMENT

Figure 1:
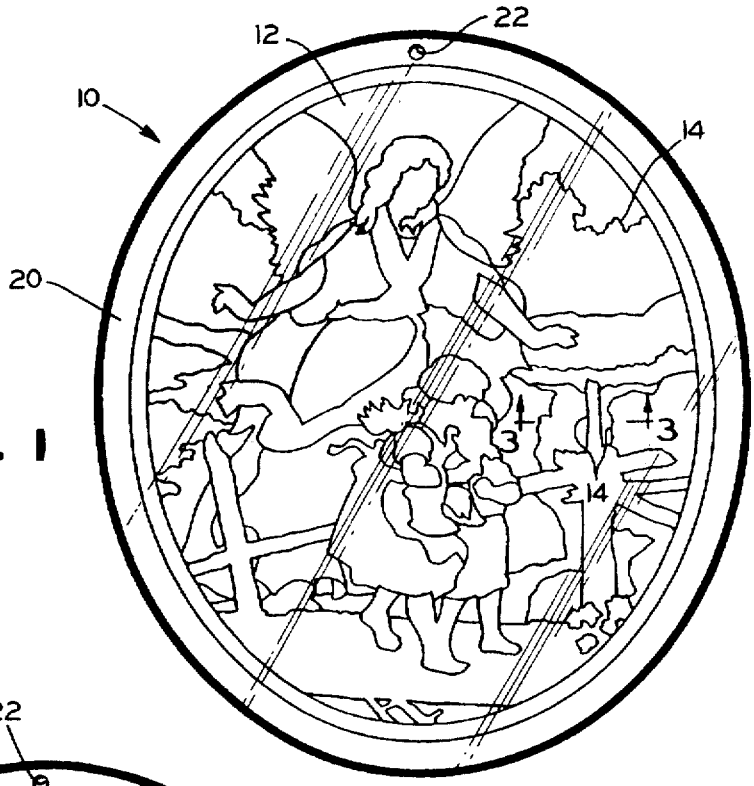
FIG. 1 is an elevational view of the undersurface of the light transmitting panel of the sun catcher kit containing an outline of a pictorial design.

Referring to the drawings, there is illustrated a sun catcher kit including a light transmitting panel 10 typically formed of a clear plastic material such as polystyrene, for example. The undersurface 12 of the panel 10 is provided with an outline of a pictorial display wherein the outline is generally defined by ridges 14. The ridges 14 are slightly raised from the plane of the undersurface 12 and are formed by an injection molding process utilized to produce the panel 10.

The undersurface 12 of the panel 10 containing the ridges 14 is capable of receiving and retaining a light transmitting coloring material such as acrylic stain, for example.

Figure 2:
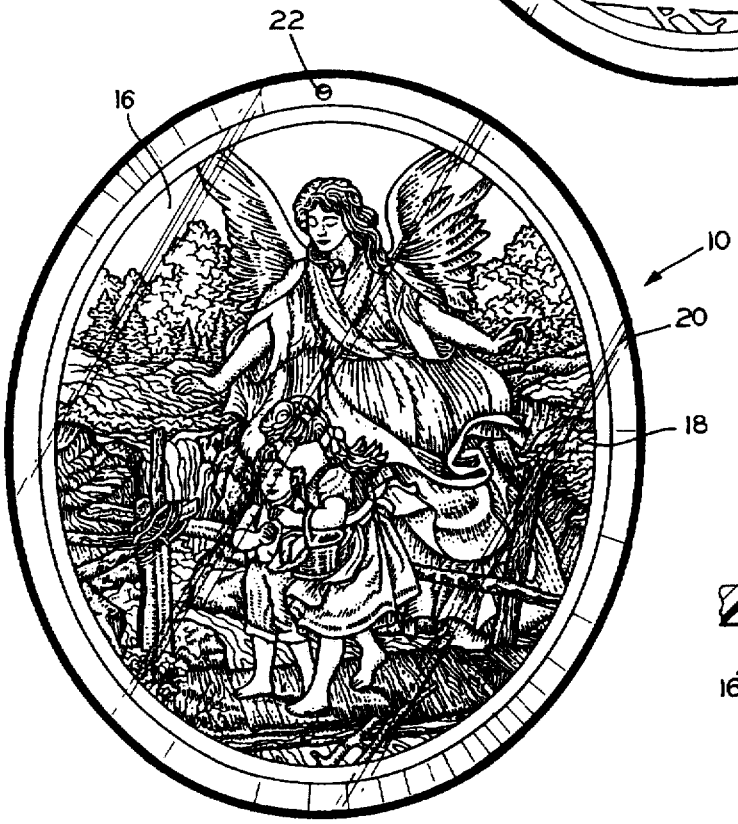
FIG. 2 is an elevational view of the opposite surface of the light transmitting panel illustrated in FIG. 1 a detailed pictorial etching type display of the pictorial outline of FIG. 1.
Figure 3:
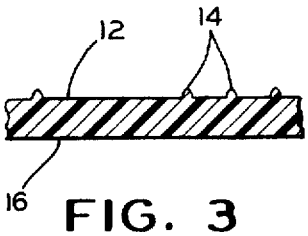
FIG. 3 is a fragmentary sectional view of the light transmitting panel taken along line 3—3 of FIG. 1.

FIG. 2 illustrates the upper surface 16 of the panel 10. The upper surface 16 is provided with a detailed etching-like pictorial display 18. The display 18 is typically silk-screened on the surface 16 in complete optical registry with the pictorial display defined by the ridges 14 of the undersurface 12.

The outer marginal edge portion 20 of the panel 10 preferably slightly beveled for aesthetic reasons and is further provided with an aperture 22 suitable for receiving a cord or the like for hanging the completed sun catcher.

In order to prepare the sun catcher kit for display purposes, the outlined areas defined by the ridges 14 are suitably painted with a brushed-on acrylic stain, for example. The use of a coloring stain such as an acrylic stain allows the light to be transmitted therethrough and hence to the detailed display 18 to achieve the desired color scheme.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A sun catcher kit including a light transmitting panel having a first flat planar surface and an opposed second flat planar surface;

a) an opaque outline of a design formed on the first flat planar surface of said panel and extending from the first flat planar surface of said panel; and b) a detailed etching-like design on the second flat planar surface of said panel in superposed registry with the design formed on the first flat planar surface of said panel.

2. A sun catcher formed by the steps of:

a) forming a light transmitting panel having a first flat planar surface and an opposed second flat planar surface;

b) forming a raised outline of a pictorial display on and extending outwardly away from the first flat planar surface of said panel;

c) forming a detailed pictorial display on the second flat planar surface of said panel in registry with the outline of the pictorial display on the first flat planar surface of said panel; and d) applying a light transmitting colored medium within the raised outline of the pictorial display on the first flat planar surface of said panel whereby the light transmitted through the colored medium will suitably illuminate the detailed pictorial display on the second flat planar surface of said panel.

* * * * *